US006387135B1

(12) United States Patent
Anderson

(10) Patent No.: US 6,387,135 B1
(45) Date of Patent: May 14, 2002

(54) TREATMENT OF HIDES

(76) Inventor: Colin Charles Anderson, 55A Main Avenue, Frewville, South Australia 5063 (AU)

( * ) Notice: Subject to any disclaimer, the term of this patent is extended or adjusted under 35 U.S.C. 154(b) by 0 days.

(21) Appl. No.: 09/486,166

(22) PCT Filed: Aug. 7, 1998

(86) PCT No.: PCT/AU98/00629

§ 371 Date: Feb. 22, 2000

§ 102(e) Date: Feb. 22, 2000

(87) PCT Pub. No.: WO99/10543

PCT Pub. Date: Mar. 4, 1999

(30) Foreign Application Priority Data

Aug. 22, 1997 (AU) ..... P08713

(51) Int. Cl.[7] ..... C14B 1/26; C14B 15/06; C14B 17/04; C14C 1/00; D06M 11/00

(52) U.S. Cl. ..... 8/94.15; 8/94.16; 8/94.18; 8/94.19 R; 8/128.1; 8/150.5; 38/102.1; 38/102.9; 38/102.91; 69/19.1; 69/19.2; 69/19.3

(58) Field of Search ..... 38/102.1, 102.9, 38/102.91; 69/19.1, 19.2, 19.3; 8/94.15, 94.19 R, 94.8, 94.16, 94.17, 128.1, 150.5, 150

(56) References Cited

U.S. PATENT DOCUMENTS

| | | | | |
|---|---|---|---|---|
| 4,333,731 | A | * | 6/1982 | Schindlmayr et al. |
| 5,000,017 | A | | 3/1991 | Petersen |
| 5,291,759 | A | | 3/1994 | Dokoupil |
| 5,396,721 | A | * | 3/1995 | Levine et al. |
| 5,868,798 | A | * | 2/1999 | Anderson et al. |

FOREIGN PATENT DOCUMENTS

| | | |
|---|---|---|
| DE | 37 02 478 | 8/1988 |
| DE | 38 33 068 | 4/1990 |
| DE | 39 30 767 | 3/1991 |
| WO | WO 89/12698 | 12/1989 |
| WO | WO 96/06192 | 2/1996 |
| WO | WO 98/45483 | 10/1998 |

* cited by examiner

*Primary Examiner*—Margaret Einsmann
(74) *Attorney, Agent, or Firm*—Akerman Senterfitt

(57) ABSTRACT

A process and apparatus for the treatment of hides and skins (3). The hide or skin is placed on a support (1, 2) and sealed to the support around the edges of the skin or hide. A treatment liquor is then supplied under pressure between the skin or hide and the support to distend and stretch the skin or hide to permit the more rapid penetration of the treatment liquor into the skin or hide.

12 Claims, 3 Drawing Sheets

TREATMENT OF HIDES

TECHNICAL FIELD

This invention relates to an improved treatment of hides and skins including green or dehydrated skins and hides, which for convenience will be called 'skins and hides' throughout the specification.

BACKGROUND ART

Skins and hides have been treated to produce leather for centuries, and a typical tanning process generally includes the curing of the green skin or hide by salting or drying prior to shipping to the tannery. At the tannery the cured skins are soaked in water to remove the salt and also any blood and dirt. This soaking may take from hours to seven days depending on the condition of the skins. The flesh is then removed from the inner surface and to loosen the hair the skin is immersed in a solution of lime and sodium sulphide from one up to nine days following which the hair is removed by a dehairing machine.

Also it is often necessary to pass the skin or hide through a dry cleaning solution to remove the fats and proteins from the skin or hide.

The skins or hides are then soaked in a weak solution of acid and simultaneously most skins are subject to a bating process. Following this the skins or hides are tanned, either by vegetable tanning which may take several weeks or months, or by chrome tanning which may be completed in a single day, the tanning involving the immersion of the skins or hides in two different liquors in a tumbling drum.

The leathers can then be lubricated and dyed, with final drying on stretching frames.

In our previous application PCT/AU97/00262 there is described a process and apparatus for the treatment of skins or hides which includes the selection of a skin or hide, stretching the skin or hide by toggles on a frame to a desired configuration and applying a chamber to the upper side of the skin or hide, sealing the chamber to the skin or hide and applying a pressurised liquor in the chamber so that the liquor penetrates the skin or hide. Means are provided on the undersurface of the skin or hide to support the distended skin or hide and also to sense the presence of the liquor penetrating the skin or hide to provide control of the treatment of the skin or hide.

However the treatment liquor must be applied to the inside of the skin or hide, that is the side opposite to the outer or wool or hair side of the skin or hide. Thus in the above specification the liquor is applied to the upper side of the skin or hide and the lower side of the skin or hide has the wool or hair attached thereto.

In tanning operations it is necessary for the wool or hair to be removed from the skin or hide, and in the above described process this can only be done when the skin or hide is removed from the toggles and the hair or wool removed before the next tanning process and the skin again attached to the toggles to maintain the stretched condition during the subsequent tanning or other treatment processes by being passed from treatment station to the next.

It is an object of the invention to provide a skin or hide treatment process or tanning process in which the process can be achieved at one station.

It is another object of the invention to provide a process and apparatus whereby the wool or hair can be easily removed without removal of the skin or hide from the apparatus.

It is a still further object of the invention to provide a process for the treatment of skins or hides whereby the process can be controlled with precision.

Another object of the invention of the invention is to provide a method and apparatus wherein the time required for treatment and tanning of the skin or hide is considerably reduced.

A still further object of the invention is to provide a method and apparatus wherein the skin or hide is treated in a stretched condition, the skin or hide remaining in the stretched condition after treatment.

Another object of the invention is to stretch the skin or hide by pressurised liquor so that fibres and cells of the skin or hide are opened to whereby the treatment liquor readily penetrates the skin or hide.

A further object of the invention is to provide a process and apparatus for the treatment of skins or hides in which the treatment liquors are recycled and/or processed to collect the materials removed from the skin or hide by the processing liquor.

A still further object of the invention is to a process and apparatus in which the pressure applied to the liquid not only accelerates the entry of the liquor into the skin or hide, but also provides the means of stretching the skin or hide to open the fibre structure.

DISCLOSURE OF THE INVENTION

Thus there is provided according to the invention a process for the treatment of skins or hides, the process including the steps of positioning the skin or hide on a frame, with the flesh side adjacent the frame, sealing the edges of the skin or hide to the support, applying treatment liquor under pressure between the skin or hide and support whereby the skin or hide is distended and stretched by the liquor under pressure to open the structure of the skin or hide to permit penetration of the treatment liquor into the skin or hide.

BRIEF DESCRIPTION OF THE DRAWINGS

In order to more fully describe the invention reference will now be made to the accompanying drawings in which.

BEST MODE FOR CARRYING OUT THE INVENTION

Figure 1:
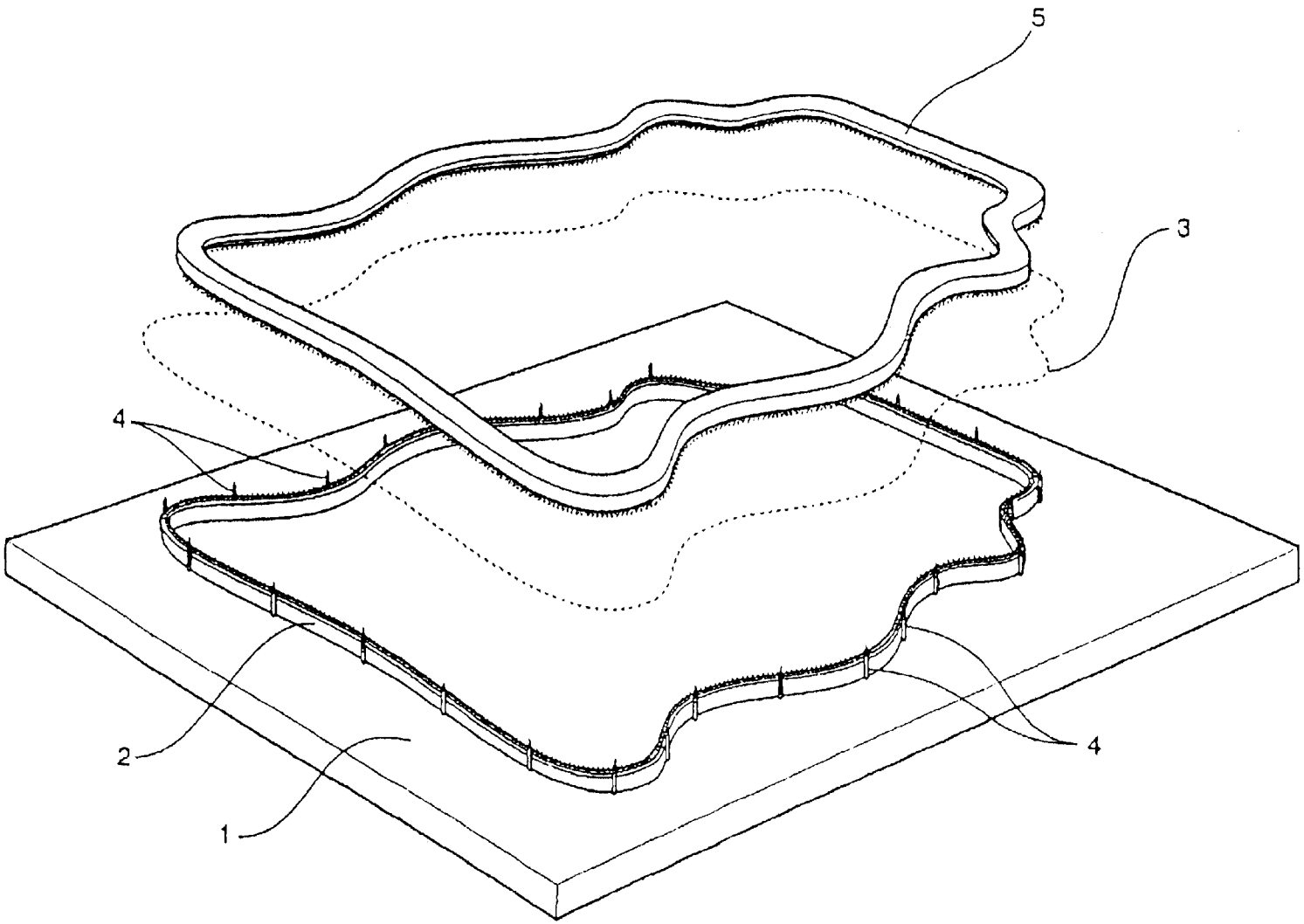
FIG. 1 is a schematic view of the support, skin or hide and sealing frame
Figure 2:
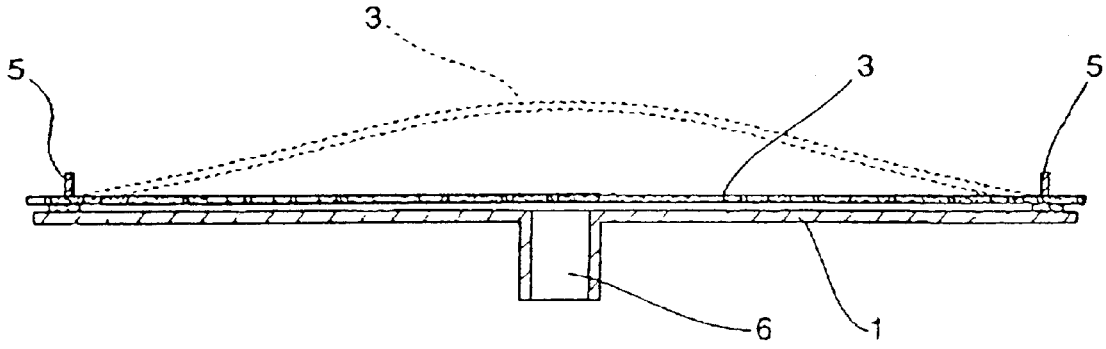
FIG. 2 is side view of one form of support

Referring to FIG. 1, the support 1, which for simplicity is illustrated as a table, has a fixed seal 2, to be described in more detail later, generally in the shape of the skin or hide 3 to be treated. The skins or hides are sorted into various sizes and thus the skin or hide will be generally of a size to be treated according to the invention. A series of pins 4 or functional alternative such as a serrated edge are positioned closely adjacent the seal 2, the purpose of the pins being to locate the skin or hide prior to the sealing of the skin or hide to the support by a sealing frame 5. The sealing frame 5 in this embodiment is an open frame so that during the process of the invention the skin or hide can stretch under inflation as shown in dotted lines in FIG. 2.

The skin or hide 3 is placed on the support and the skin or hide pinned in position either manually or mechanically which may be automatic or manually controlled. The sealing frame is then lowered and seals the skin or hide to the support. Although not shown the sealing frame may be mounted on the support, for example by a parallel linkage arrangement so that it can be raised and swung away from the support. Alternately the sealing frame can be mounted on vertical posts which may be telescopic to enable the sealing frame to be raised and lowered.

A port 6 is provided in the support 1 through which a treating liquor is supplied under pressure. The skin is thus distended and stretched, the amount of stretch being up to 15% or more. The stretch thus opens the skin and the fibres are thus separated which permits the entry of the treating liquor to penetrate into the skin or hide. The skin or hide maybe fully penetrated within a few minutes or less, compared with many hours with conventional processes.

Figure 3:
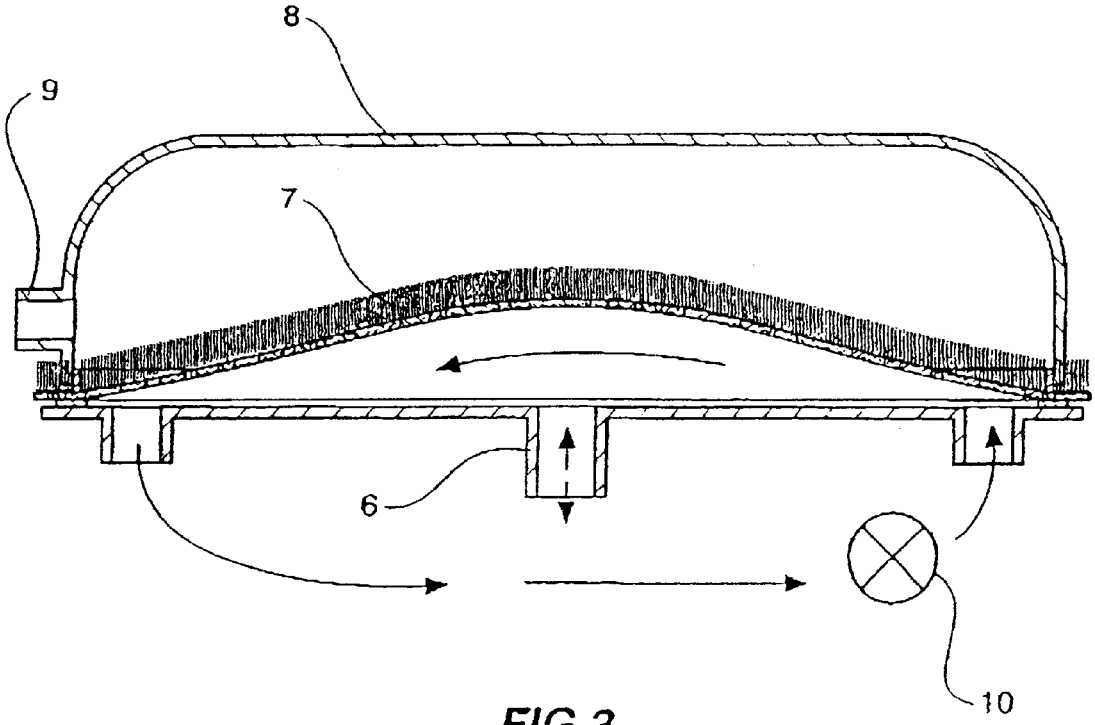
FIG. 3 is a side view of another form of the invention

FIG. 3 illustrates a further embodiment of the invention for the treatment of sheep skins. The skin 7 is placed in position, and a hood 8 having an inlet 9 is then placed over the skin and seals onto the sealing frame 5. While the skin is stretched with a treatment liquor, a scouring liquid is then passed into the hood to scour the wool. In this way the scouring can take place as part of the treatment process of the skin without the scouring having to be undertaken as a separate process. Also if desired as shown in FIG. 3, the treatment liquor can be recirculated by means of a pump, so that there is a continuous supply of treatment liquor, and which circulation assists in removing material obtained from the hide or skin during the treatment process.

Also it is preferred that the treatment liquor be continually passed over the surface of the skin, preferably in a turbulent motion. A baffle or baffles may be positioned adjacent the inlet or recirculating inlet to create a turbulent flow, and also to prevent the direct impingement of the pressurised liquid onto the skin. These baffles may have holes there through to assist in creating the degree of turbulence. Furthermore there may be a plurality of inlet orifices which may be directed to produce a turbulent flow across the surface of the skin.

Figure 4:
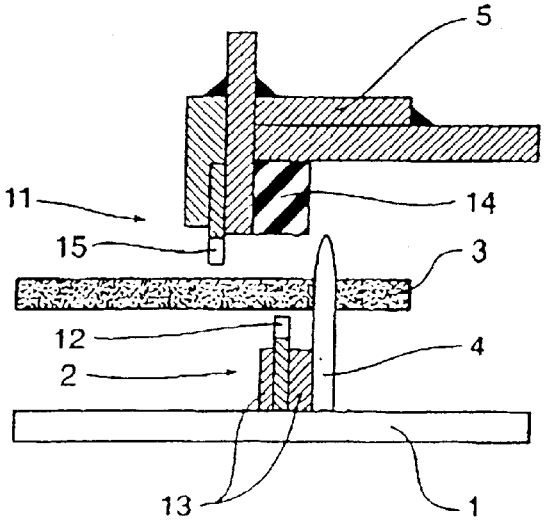
FIG. 4 is a partial view of the seal and skin or hide prior to sealing
Figure 5:
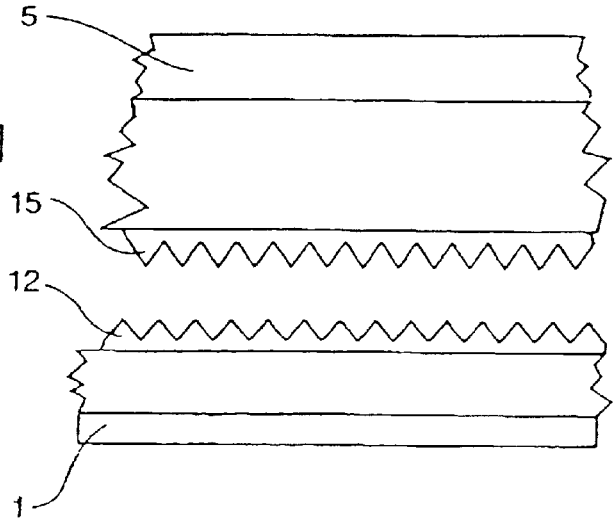
FIG. 5 is a side view of the seals.
Figure 6:
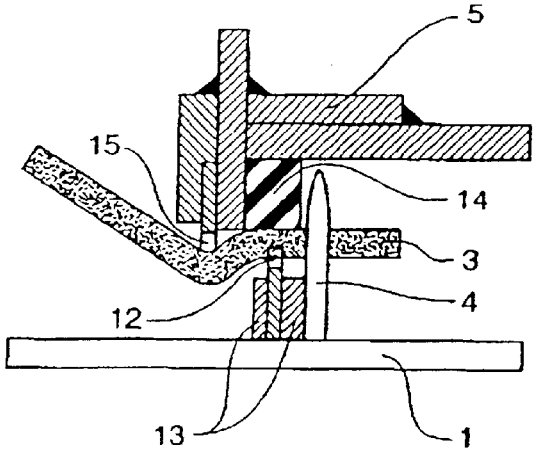
FIG. 6 is a view of the skin or hide being sealed to the support.

FIGS. 4 to 6 show a preferred seal 2 and co-operating seal 11 in the frame 5. The seal 2 includes a serrated member or blade 12 attached to or clamped in position on the support 1 by annular members 13. The co-operating seal 11 on the frame 5 includes a resilient ring of rubber or silicon rubber or other resilient material 14 positioned to be above the serrated member 12 in the sealing position. The seal 11 also includes a downwardly facing serrated member 15 spaced inwardly of the serrated member 12 so that in the sealing position the skin or hide is deflected around the serrated member 15 ensuring that the skin or hide is securely held by the two co-operating serrated members 12 and 15. It has been found that due to the nature of a wet hide or skin, a suitable seal or clamp must be such that it will grip the skin or hide which is under tension due to the pressure under the skin or hide. Thus to ensure that the seal grips the skin or hide, seal must include members which are rough or serrated so that the gripping member at least partially indents or protrudes into the surface of the skin or hide. As shown a serrated member is satisfactory, and preferably the serrated member can be in the form of a continuous band which can be bent as desired to the contour of the skin or hide.

In a further embodiment the frame 5 may be a separate frame not mounted on the support to which the skin or hide is attached prior to the separate frame being positioned on the support. The frame which is mounted on the support, or a separate pressure applying frame is then lowered and seals on the separate frame and the support. In this way skins or hides may be attached to a separate frame and then the frame with the skin or hide attached may be removed for removal of the skin or hide from the frame, or for further processing.

In the treatment of skins or hides, it will be seen that most if not all of the steps necessary for the treatment or tanning of skins or hides can be carried out in a quick and efficient manner, reducing the time required from days to hours and even minutes for some treatments.

After positioning the skin or hide, the skin or hide can first be treated with a detergent or dry cleaning procedure to remove the fats from the skin or hide. By removing the fats, the time for the ensuing treatments is greatly reduced, due to the fact that the presence of fats hinders the penetration of the treatment liquor. Also the process permits the removal of hair and wool from the skin or hide if the skin or hide is to be treated to be leather. The dehairing liquor is applied to pressurise the skin or hide, the dehairing liquor thus penetrating the skin or hide to destroy the hair or wool follicles. With the skin or hide in the stretched condition the hair or wool can be removed by brushing or by a vacuum pump. However, if the sheep skin is to be treated with the wool remaining to produce products such as rugs or mats, or items of clothing, the wool is not removed but is scoured as described above.

Thus by sequential addition and removal of liquors with the skin in the stretched condition, the skin or hide can be treated. Also by the process it is possible to have complete control over the time of treatment for each skin or hide. If desired the a cleansing solution either water or detergent can be applied between each operation of the process to remove the previous liquor and to flush away any matter removed form the skin or hide.

The skin or hide is stretched up to 15% and in order to retain the skin or hide in the stretched condition, the skin or hide is dried. This can be while positioned on the support. Additionally the skin or hide on the separate frame may be then positioned on a separate support for the drying operation. Also a further stretching may be applied to the portion of the hide or the area of the seal It has been found that with most hides and skins the thickness is greater along the back in the spine area. To produce a hide or skin of uniform thickness, the hide or skin can be stretched longitudinally along the central area by tensioning the hide or skin longitudinally when being attached to the pins. This tensioning can be done manually or mechanically by attaching toggles to the relevant portion of the hide or skin.

However it in many instances the use of the pins may not be required, the skin or hide is placed in position without tension, and by pressing the hide onto the serrated seal member the skin or hide is held in position while the sealing framed is lowered and sealed onto the skin or hide. However if longitudinal tensioning is required along the spine area of the skin or hide, then pins can be positioned a the appropriate areas to which the skin or hide can be pinned after stretching.

Also it is preferred that the treatment liquor be continually passed over the surface of the skin, preferably in a turbulent motion, this being more desirable when removing the fats and proteins by a detergent solution. A baffle may be positioned over the inlet or recycling inlet to prevent the direct impingement of the pressurised liquid onto the skin. The baffles may have holes or inclined orifices to assist in creating the turbulent flow, and also there may be a plurality of inlet orifices to assist in creating a flow of detergent over the surface of the skin. It has been found that the pressure of the liquid under the skin or hide need only be in the order of 1 psi, although higher pressures may be desirable in some instances.

Also, it is within the scope of the invention that the skins or hides to be treated are green skins or hides, without have been salted for preservation.

Also the liquors are recycled and stored for the next treatment operation, thus being more environmentally friendly. Additionally the liquor used for the removal of the fats and proteins can be subject to further treatment to remove the fats and proteins which themselves are a valuable commodity.

Thus it will be seen that there is provided according to the invention a process and apparatus for the treatment of hides and skins by which the processing and treatments times are greatly reduced.

What is claimed is:

1. A process for the treatment of skins or hides, comprising the steps of:

providing a frame having a sealing member corresponding to the profile of the skin or hide;

positioning the skin or hide on the frame with the flesh side adjacent to the frame;

sealing the edges of the skin or hide to the frame with an open sealing frame; and applying treatment liquor under pressure between the skin or hide and the frame, whereby the skin or hide is distended and stretched by the liquor under pressure to open the structure of the skin or hide to permit penetration of the treatment liquor into the skin or hide.

2. A process as defined in claim 1 wherein the treatment liquor is a detergent or drycleaning solution applied to the skin or hide to substantially remove the fats and proteins therefrom.

3. A process as defined in claim 1 wherein the treatment liquor is dehairing liquor applied between the frame and the skin or hide to loosen the wool or hair follicles, and removing the wool or hair while the skin or hide is positioned in the distended and stretched condition on the frame.

4. A process as defined in claim 1 wherein the skin or hide is a sheep skin, including the step of positioning a cover over a sheep skin, sealing the edges of the cover to the skin, and applying a scouring liquid into the cover to scour the wool.

5. A process as defined in claim 1 including the stops of applying a treatment liquor to the skin or hide to stretch and treat the skin or hide, draining said liquor to a reservoir, pressursing said skin or hide with a second treatment liquor, draining said liquor and sequentially repeating the process with further treatment liquors.

6. A process as defined in claim 5 including the steps of collecting the drained liquor for recycling by reuse on subsequent skins or hides.

7. A process as defined in claim 1 further including the step of collecting the liquor after use to recover fats and proteins therefrom.

8. A process as defined in claim 1, including the step of applying a tanning treatment liquor to the skin or hide.

9. An apparatus for the treatment of skins or hides, said apparatus including a frame having floor, a profiled sealing member on said floor corresponding to the profile of the skin or hide, an open sealing frame to seal the edge of the skin or hide on the profiled sealing member, and means to supply pressurised treatment liquor between the floor and the skin or hide to distend and stretch the skin or hide and thus assist in the passage of the liquor through the skin or hide.

10. An apparatus as defined in claim 9 wherein the profiled sealing member comprises at least one upstanding rigid serrated sealing edge, and a rubber seal on the inner surface of the profiled sealing member.

11. An apparatus as defined in claim 9 wherein the open sealing frame has a downwardly facing seal comprising a rubber sealing member, and positioned adjacent thereto on the inner side of the downwardly facing seal a downwardly facing serrated edge extending below the lower surface of the rubber sealing member whereby in operation the rubber sealing member presses the skin or hide onto the at least one serrated sealing edge, and the downwardly facing serrated edge presses the skin or hide below the at least one serrated edge to deflect and lock and seal the skin or hide edge to withstand the pressure under the skin or hide.

12. An apparatus as defined in claim 9 wherein the means to supply pressurised liquor through the floor comprises a pump delivering the liquor through at least one delivery aperture in the floor.

* * * * *